US006324780B1

(12) United States Patent
Behling

(10) Patent No.: US 6,324,780 B1
(45) Date of Patent: Dec. 4, 2001

(54) FLUTED GUN BARREL

(75) Inventor: Carl H. Behling, Upper St. Clair, PA (US)

(73) Assignee: E.R. Shaw, Inc., Bridgeville, PA (US)

( * ) Notice: Subject to any disclaimer, the term of this patent is extended or adjusted under 35 U.S.C. 154(b) by 0 days.

(21) Appl. No.: 09/350,555

(22) Filed: Jul. 9, 1999

(51) Int. Cl.[7] ..... F41A 21/00
(52) U.S. Cl. ..... 42/78; 89/14.05
(58) Field of Search ..... 42/78; 89/14.05

(56) References Cited

U.S. PATENT DOCUMENTS

| | | | | |
|---|---|---|---|---|
| 315,746 | | 4/1885 | Costa De Arguibel | 42/78 |
| 587,801 | * | 8/1897 | Durnford | 42/78 |
| 840,085 | * | 1/1907 | Mulock | 42/78 |
| 1,167,233 | | 1/1916 | Warner | 42/76.01 |
| 2,609,631 | | 9/1952 | Garand | 42/76.01 |
| 2,792,657 | | 5/1957 | Slowter | 42/76.02 |
| 3,228,298 | * | 1/1966 | Grandy et al. | 89/16 |
| 3,483,794 | * | 12/1969 | Packard | 89/14.2 |
| 3,673,916 | | 7/1972 | Wittholz | 89/14.05 |
| 3,738,044 | * | 6/1973 | Robinson | 42/75 |
| 3,777,385 | * | 12/1973 | Hagan | 42/76 |
| 5,054,224 | | 10/1991 | Friar et al. | 42/76.02 |
| 5,664,359 | | 9/1997 | Sabranski et al. | 42/76.01 |

OTHER PUBLICATIONS

Stoeger Publishing Company: Shooter's Bible No. 92 2001 Edition; pp. 185, 271.

* cited by examiner

*Primary Examiner*—Charles T. Jordan
*Assistant Examiner*—Michelle Thomson
(74) *Attorney, Agent, or Firm*—Webb Ziesenheim Logsdon Orkin & Hanson, P.C.

(57) ABSTRACT

A gun barrel having a generally hollow cylindrically-shaped barrel with a first end, a second end, an inner surface and an outer surface. The inner surface defines a plurality of internal spiral grooves and the outer surface defines a plurality of external spiral grooves.

20 Claims, 2 Drawing Sheets

FLUTED GUN BARREL

BACKGROUND OF THE INVENTION

1. Field of the Invention

The present invention relates to gun barrels.

2. Description of the Prior Art

Shotgun barrels and rifle barrels are elongated metallic tubes attached to a firing mechanism and a gun stock. Rifles get their name from the "rifling" provided within the gun barrel. Specifically, rifling is a system of spiral grooves formed in the surface of the bore of a gun barrel causing a bullet to rotate when fired. Rifling may also be provided on shotguns. This rotation results in a more accurate gun. The number of spiral grooves varies, depending on the bore size and other factors.

It is generally accepted that the thicker the gun barrel wall is, the more accurate the gun. As might be expected, thick walled gun barrels can add significant weight to the shotgun or the rifle. However, shotguns and rifles having thick walled barrels may be difficult to carry, especially through wooded areas. Further, in competition, different classes generally are determined by the weight of the firearm, i.e., rifle. In an effort to have a more accurate shooting rifle, yet a lighter rifle, straight flutes or grooves have been formed on the outer surface of the gun barrel, while rifling is present on the surface of the bore. Although the straight flutes or grooves provide some improvement, the straight flutes or grooves do not remove a substantial amount of the excess weight from the gun barrel.

Therefore, it is an object of the present invention to provide a strong, lightweight, and accurate gun barrel.

SUMMARY OF THE INVENTION

The present invention is a gun barrel that includes an open-ended hollow body, such as a hollow generally cylindrically-shaped barrel, having a first end, a second end, an inner surface and an outer surface. The inner surface defines a gun barrel bore and defines a plurality of internal helical or spiral grooves. The outer surface defines a plurality of external helical or spiral grooves. The number of internal spiral grooves equals the number of external spiral grooves. The internal spiral grooves and the external spiral grooves define sets of grooves defined by one of the internal grooves and one of the external grooves. Each set of grooves extends along a spiral. Each of the internal grooves are equally spaced apart and each of the external grooves are equally spaced apart. The plurality of external grooves preferably extends over a portion of the barrel between the two ends, while the internal grooves extend to the first end of the barrel. Preferably, each of the external grooves has a depth that is different than a depth of each of the internal grooves.

The present invention is also a gun that includes a gun stock and a firing mechanism attached to the above-described gun barrel.

Also, the present invention is a method for manufacturing a gun barrel that includes the steps of: providing a rod; forming a bore in the rod defining an interior surface; forming a plurality of internal spiral grooves in the interior surface; and forming a plurality of external spiral grooves on an exterior surface of the rod. Preferably, the number of external spiral grooves should be the same number of internal spiral grooves. Preferably, the method is accomplished with the aid of a four-axis computer aided machine.

DESCRIPTION OF THE PREFERRED EMBODIMENTS

Figure 1:
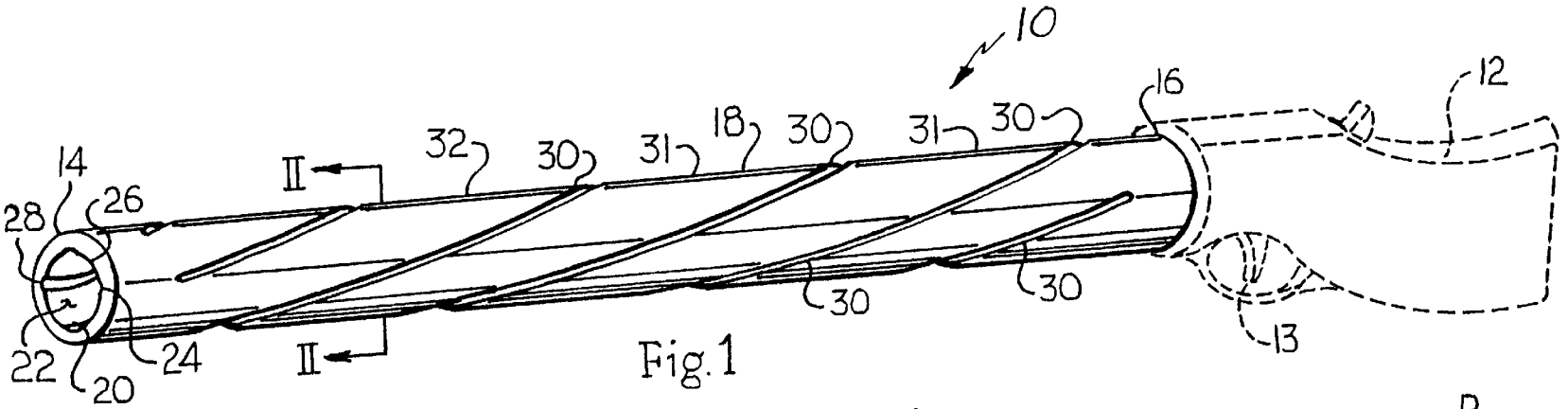
FIG. 1 is a perspective view of a gun barrel made in accordance with the present invention showing a gun stock and firing mechanism in phantom.
Figure 3:
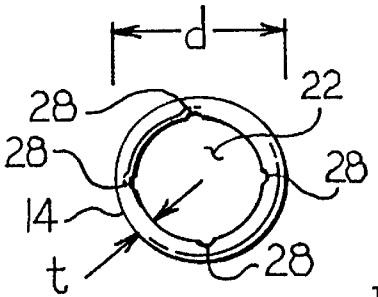
FIG. 3 is an elevational end view of the gun barrel shown in FIG. 1.
Figure 2:
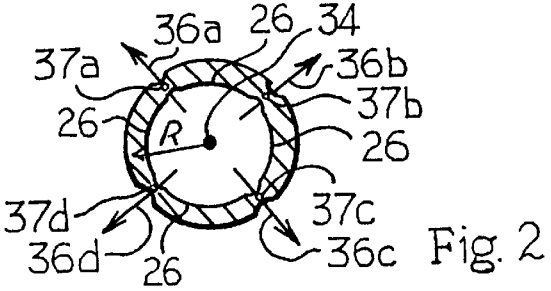
FIG. 2 is a sectional view taken along lines II—II.

FIG. 1 shows a gun barrel 10 made in accordance with the present invention. The gun barrel 10 is secured to the gun stock 12 and a firing mechanism 13, which are shown in phantom. Gun stocks and firing mechanisms are well known in the art and will not be discussed in any further detail. The gun barrel 10 is used typically with shotguns and rifles. The gun barrel 10 is a hollow open-ended body that is generally a cylindrically-shaped barrel. By generally cylindrical in shape, it is meant that the gun barrel is cylindrical or tapered in shape over at least a portion of its length. The gun barrel 10 includes a first end or crown 14 and an opposite second end or breach end 16. The barrel includes an outer surface or exterior surface 18 and an inner surface or interior surface 20. The inner surface 20 defines a bore 22. Rifling 24 is defined on the inner surface 20. As shown in FIGS. 1–3, the rifling includes a plurality of spaced spiral or helical lands 26 and a plurality of spaced internal spiral or helical grooves 28. The outer surface 18 defines a plurality of spaced external spiral or helical flutes or grooves 30 and a plurality of spaced spiral or helical lands 31. The spiral flutes 30 are defined on an intermediate portion 32 of the gun barrel 10. The intermediate portion 32 is defined between the ends 14 and 16. The gun barrel 10 is secured to the gun stock 12 and firing mechanism 14 at the end 16 in a manner which is well known in the art. There are the same number of internal spiral grooves 28 as external spiral grooves 30.

Figure 6:
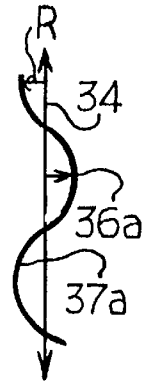
FIG. 6 is a representation of a spiral groove extending along an axis.

Referring to FIG. 2, a central longitudinally extending axis 34 passes through a center of the barrel 10. The respective spiral grooves 28 and spiral grooves 30 are positioned on respective radial axes 36*a*, 36*b*, 36*c* and 36*d* that extend from the central axis 34. The axes are equally spaced apart, in this case, 90°. As can be seen in FIG. 2, the respective grooves 28 and flutes 30 are positioned on radial axes 36*a*, 36*b*, 36*c* and 36*d*, which follow spirals 37*a*, 37*b*, 37*c* and 37*d*, respectively. The radial axes 36*a*, 36*b*, 36*c* and 36*d* rotate as a function of their position along the longitudinal axis 34 following respective spirals or helixes 37*a*, 37*b*, 37*c* and 37*d*. FIG. 6 shows a representation of the radial axis 36a and spiral 37a extending along axis 34. Preferably, the spiral or helix travels along the longitudinal axis 34 at a constant angle so that the pitch (h) of the helix equals 2 $\pi$R tan , where R= the radial distance of the spiral from the longitudinal axis 34. As can be seen in FIGS. 1, 2, 4, and 5, the internal spiral grooves 28 are not in fluid communication with the external spiral grooves 30. A cross section taken through the intermediate portion 32, which is transverse to the longitudinal axis 34, shows the external spiral grooves 30 radially spaced from the longitudinal axis 34. The internal grooves 28 and the external grooves 30, when viewed from the first end 14, progress in the same direction of rotation.

Figure 5:
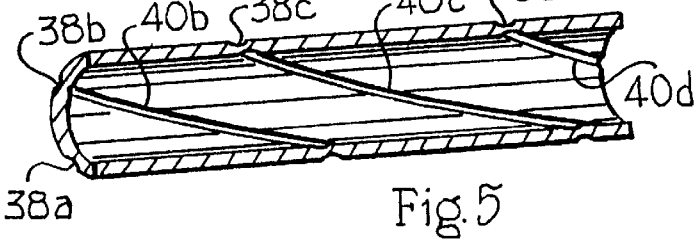
FIG. 5 is a perspective view of the portion of the internal portion of the gun barrel shown in FIG. 4.
Figure 4:
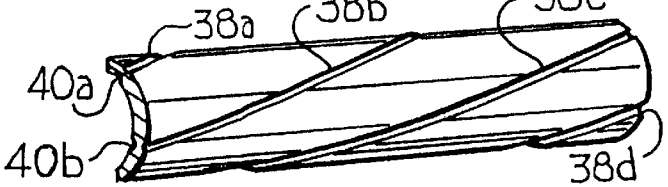
FIG. 4 is a perspective view showing a partial section of the external portion of the gun barrel shown in FIG. 1.

FIGS. 4 and 5 show respective pairs or sets of grooves or flutes that are defined by reference numerals 38*a* and 40*a*; 38*b* and 40*b*; 38*c* and 40*c*; and 38*d* and 40*d*. Each pair of flutes or grooves extend along spirals 37*a*, 37*b*, 37*c* and 37*d*, respectively. Although four sets of 30 grooves or spirals are shown in FIGS. 1–5, any number of sets or pairs of grooves or spirals can be provided such as, for example, six grooves or spirals and eight grooves or spirals. Also, the pitch and angle of rotations can be varied depending on the size of the barrel and the bullet 35 size. For example, the pitch for the rifles can be one revolution for every sixteen inches of barrel length, one revolution for every fourteen inches of barrel length, one revolution for every ten inches of barrel length, or one revolution for every nine and a half inches of barrel length. Typically, shotguns can have a pitch of one revolution for every forthy-eight (48) inches of barrel length. Typically, the above-described gun barrel 10 will have a right-handed groove or spiral rotation, although left-handed spiral or groove rotation can be used. Preferably, the depth of the flutes 30 and the grooves 28 are different. For example, the grooves 28 can have a depth of 0.001–0.005 inches and the flutes 30 can have a depth of approximately 0.100 inches. Preferably, the minimum diameter of the barrel onto which the above-described rifling and fluting is utilized is on the order of 0.600 inches. Preferably, the wall thickness t is on the order of 0.375 inches or greater.

Preferably, the spiral flutes or grooves 30 are positioned on an intermediate portion 32 between the end 14 and 16. The helical or spiral grooves 28 are provided from the end 14 toward the end 16 but will typically terminate before the end 16. Further, a connecting arrangement which is defined at the end 16 can be machined for receipt of hardware for connecting the gun barrel 10 to the gun stock 12 and firing mechanism 13 in a manner well known in the art, and therefore is not shown.

It is believed that the spiral or helical grooves 28 and the spiral flutes or grooves 30 as described previously herein, will result in a gun barrel 10 that is lighter than a gun barrel not having flutes 30, while emulating the stiffness and the harmonic response of a heavier gun barrel. Further, the spiral flutes 30 permit the gun barrel 10 to cool quicker than gun barrels with straight flutes or no flutes. For example, if the gun barrel 10 has spiral flutes that are twenty percent longer than straight flutes for the same length of a gun barrel then it is believed that the spiral fluted gun barrel will cool twenty percent faster than the straight fluted gun barrel. Further, it is believed that the stiffness characteristics will improve with the spiral fluted gun barrel over a straight fluted gun barrel. Also, although the present invention is preferably used with shotguns and rifles, it may also be used with other guns such as handguns.

Figure 7:
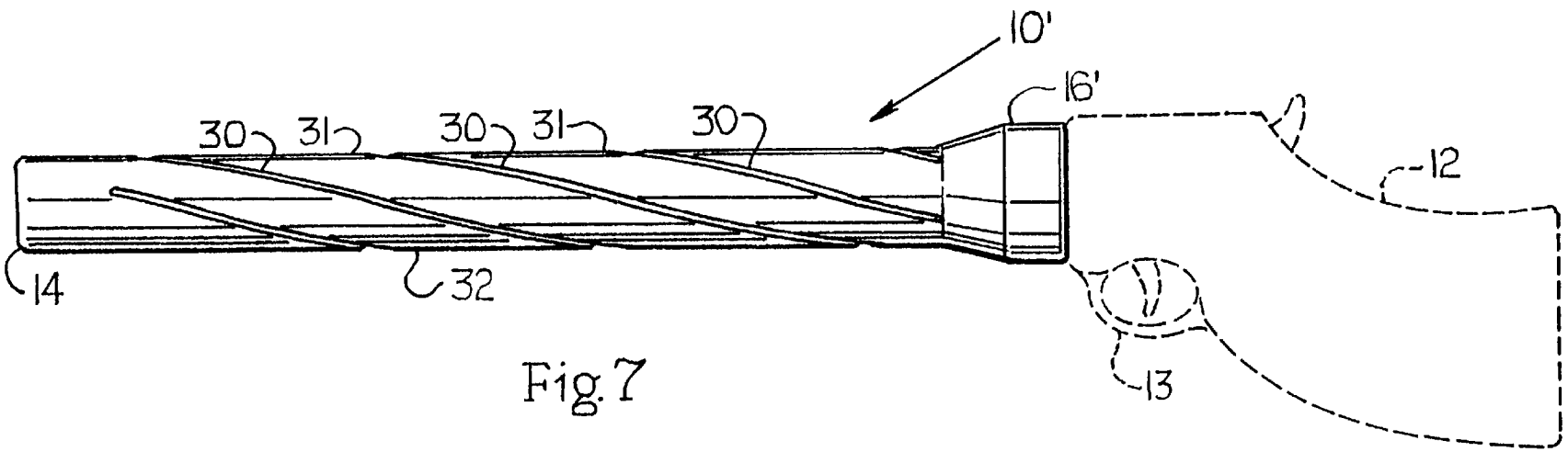
FIG. 7 is a side elevational view of a second embodiment of a gun barrel made in accordance with the present invention showing a gun stock and firing mechanism in phantom.

FIG. 7 shows a gun barrel 10' substantially similar to gun barrel 10 except for the tapered end 16'.

The method for manufacturing the gun barrel 10 will now be described. Typically, the gun barrel 10 will begin as a rod of steel, preferably cylindrical in shape. The bore will then be formed by machining so that the interior surface or inner surface 20 is defined. An external surface of the rod may also be machined so that the rod has a taper and appropriate configurations such as slots for attachment to the gun stock 12 and firing mechanism 14. Then the plurality of helical or spiral grooves 28 are cold formed in the inner surface 20. Alternatively, the helical or spiral groups can be machined. Then a plurality of helical or spiral flutes 30 are formed by machining on the outer surface 18. Preferably, the flutes 30 are formed by machining on the intermediate portion 32 of the gun barrel 10, while the grooves 28 are formed from the end 14. It is preferred that a four axis computer aided machine be used to form the flutes 30 such as a Fadal, Inc. Model No. VMC15XT 194-15.

The four-axis computer aided machine may also be used to form the bore 22 and the rifling 24.

Having described the presently preferred embodiments of the invention, it is to be understood that it may be otherwise embodied within the scope of the appended claims.

I claim:

1. A gun barrel, comprising:

an open-ended hollow body extending along a longitudinal axis, said body having a first end, a second end, an intermediate portion positioned between said first end and said second end, an inner surface and an outer surface, said inner surface defining a gun barrel bore and a plurality of internal spiral grooves and said outer surface defining a plurality of external spiral grooves, wherein the internal spiral grooves are not in fluid communication with the external spiral grooves, and wherein a cross section taken through the intermediate portion, which is transverse to the longitudinal axis, includes an external spiral groove and an internal spiral groove radially spaced from the longitudinal axis, and wherein the plurality of internal grooves and the plurality of external grooves when viewed from said first end progress in the same direction of rotation.

2. A gun barrel as claimed in claim 1 wherein said body is a generally hollow cylindrically-shaped barrel.

3. A gun barrel as claimed in claim 1, wherein each of said external grooves has a depth that is different than a depth of each said internal grooves.

4. A gun, comprising:

a gun stock;

a firing mechanism; and a gun barrel secured to said gun stock and said firing mechanism, said gun barrel comprising:

an open-ended hollow body extending along a longitudinal axis, said body having a first end, a second end, an intermediate portion positioned between said first end and said second end, an inner surface and an outer surface, said inner surface defining a gun barrel bore and a plurality of internal spiral grooves and said outer surface defining a plurality of external spiral grooves, wherein the internal spiral grooves are not in fluid communication with the external spiral grooves, and wherein a cross section taken through the intermediate portion, which is transverse to the longitudinal axis, includes an external spiral groove and an internal spiral groove radially spaced from the longitudinal axis, and wherein the plurality of internal grooves and the plurality of external grooves when viewed from said first end progress in the same direction of rotation.

5. A gun as claimed in claim wherein said body is a generally hollow cylindrically-shaped barrel.

6. A gun as claimed in claim 4, wherein each of said external grooves has a depth that is different than a depth of each of said internal grooves.

7. A gun barrel, comprising:

an open-ended hollow body having a first end, a second end, an inner surface and an outer surface, said inner surface defining a gun barrel bore and a number of internal spiral grooves and said outer surface defining a number of external spiral grooves, wherein the number of the internal spiral grooves equals the number of the external spiral grooves.

8. A gun barrel as claimed in claim 7, wherein said body is a generally hollow cylindrically-shaped barrel.

9. A gun barrel as claimed in claim 7, wherein said respective internal grooves and external grooves define sets of grooves defined by one of said internal grooves and one of said external outer grooves, each of said set of grooves extending along a spiral.

10. A gun barrel as claimed in claim 9, wherein each of said internal grooves are equally spaced apart and each of said external grooves are equally spaced apart.

11. A gun barrel as claimed in claim 10, wherein said plurality of external grooves extends over a portion of the barrel between said two ends.

12. The gun barrel as claimed in claim 11, wherein said plurality of internal grooves extend to the first end of said barrel.

13. A gun barrel as claimed in claim 7, wherein each of said external grooves has a depth that is different than a depth of each said internal grooves.

14. A gun, comprising:

a gun stock;

a firing mechanism; and a gun barrel secured to said gun stock and said firing mechanism, said gun barrel comprising:

an open-ended hollow body having a first end, a second end, an inner surface and an outer surface, said inner surface defining a gun barrel bore and a number of internal spiral grooves and said outer surface defining a number of external spiral grooves, wherein the number of said internal spiral grooves equal the number of said external spiral grooves.

15. A gun as claimed in claim 14, wherein said body is a generally hollow cylindrically-shaped barrel.

16. A gun as claimed in claim 14, wherein said respective internal grooves and external grooves define sets of grooves defined by one of said internal grooves and one of said external grooves, each of said set of grooves extending along a spiral.

17. A gun as claimed in claim 16, wherein each of said internal grooves are equally spaced apart and each of said external grooves are equally spaced apart.

18. A gun as claimed in claim 17, wherein said plurality of external grooves extends over a portion of the barrel between said two ends.

19. A gun as claimed in claim 18, wherein said plurality of internal grooves extend to the first end of said barrel.

20. A gun as claimed in claim 14, wherein each of said external grooves has a depth that is different than a depth of each of said internal grooves.

* * * * *

UNITED STATES PATENT AND TRADEMARK OFFICE

CERTIFICATE OF CORRECTION

PATENT NO. : 6,324,780 B1
DATED : December 4, 2001
INVENTOR(S) : Carl H. Behling It is certified that error appears in the above-identified patent and that said Letters Patent is hereby corrected as shown below:

Column 2,
Line 57, "constant angle so" should read -- constant angle $\propto$ so --.
Line 58, "tan ," should read -- tan $\propto$, --.

Column 3,
Line 21, "inches" should read -- inch --.
Line 22, "0.100 inches." should read -- 0.100 inch. --.
Line 24, "0.600 inches." should read -- 0.600 inch --.
Line 25, "0.375 inches" should read -- 0.375 inch --.

Column 4,
Line 55, "in claim wherein" should read -- in claim 4 wherein --.

Column 5,
Line 15, "extend" should read -- extends --.

Column 6,
Line 4, "equal" should read -- equals --.
Line 15, "are equally" should read -- is equally --.
Line 16, "are equally" should read -- is equally --.
Line 21, "extend" should read -- extends --.

Signed and Sealed this

Seventh Day of May, 2002

*Attest:*

*Attesting Officer*

JAMES E. ROGAN
*Director of the United States Patent and Trademark Office*